US008770180B2

(12) United States Patent
Kim et al.

(10) Patent No.: US 8,770,180 B2
(45) Date of Patent: Jul. 8, 2014

(54) OVEN RANGE

(75) Inventors: Yang-Ho Kim, Changwon-si (KR); Jung-Wan Ryu, Changwon-si (KR); Dae-Bong Yang, Changwon-si (KR); Yong-Ki Jeong, Changwon-si (KR); Jae-Bum Lim, Changwon-si (KR); Young-Soo Kim, Changwon-si (KR); Dae-Rae Lee, Changwon-si (KR); Jea-Hyuk Wie, Changwon-si (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 13/056,938

(22) PCT Filed: Jul. 30, 2009

(86) PCT No.: PCT/KR2009/004268

§ 371 (c)(1),
(2), (4) Date: Apr. 21, 2011

(87) PCT Pub. No.: WO2010/013964

PCT Pub. Date: Feb. 4, 2010

(65) Prior Publication Data

US 2011/0186032 A1 Aug. 4, 2011

(30) Foreign Application Priority Data

Aug. 1, 2008 (KR) ..... 10-2008-0075767
Aug. 1, 2008 (KR) ..... 10-2008-0075770

(51) Int. Cl.
*A21B 1/00* (2006.01)

(52) U.S. Cl.
USPC ..... 126/21 R; 126/21 A

(58) Field of Classification Search
USPC ..... 126/21, 21 R, 21 A, 1 AD, 193, 290, 126/41 D, 15 R, 19 R; 219/400
See application file for complete search history.

(56) References Cited

U.S. PATENT DOCUMENTS

| | | | | | |
|---|---|---|---|---|---|
| 1,950,212 | A | * | 3/1934 | Barnett et al. | 432/176 |
| 3,364,912 | A | * | 1/1968 | Dills et al. | 126/21 A |
| 3,530,847 | A | * | 9/1970 | Saponara et al. | 126/21 R |
| 3,587,557 | A | * | 6/1971 | Henderson | 26/21 A |
| 3,613,656 | A | * | 10/1971 | Henderson | 126/21 R |
| 3,624,742 | A | * | 11/1971 | Hurko et al. | 126/39 D |
| 3,667,450 | A | * | 6/1972 | Skafte | 126/85 B |
| 3,812,838 | A | * | 5/1974 | Mutchler | 126/21 A |
| 3,859,499 | A | * | 1/1975 | Evans et al. | 219/396 |
| 3,921,617 | A | * | 11/1975 | Rumbaugh | 126/21 R |
| 3,973,551 | A | * | 8/1976 | Caselani et al. | 126/21 A |
| 4,108,139 | A | * | 8/1978 | Gilliom et al. | 126/21 A |
| 4,180,049 | A | * | 12/1979 | Carr et al. | 126/21 A |
| 4,248,203 | A | * | 2/1981 | Willson | 126/77 |
| 4,265,213 | A | * | 5/1981 | Gorsuch et al. | 126/66 |

(Continued)

FOREIGN PATENT DOCUMENTS

| | | |
|---|---|---|
| CN | 200956795 | 10/2007 |
| KR | 10-2004-0007983 | 1/2004 |

*Primary Examiner* — Kenneth Rinehart
*Assistant Examiner* — Gajanan M Prabhu
(74) *Attorney, Agent, or Firm* — McKenna Long & Aldridge LLP

(57) ABSTRACT

The present invention relates to an oven range. In the present invention, the air heated by the burner is guided by the air duct and transferred into the oven chamber, and guided so as to flow evenly in the oven chamber by the air guide. Therefore, the cooking food can be more efficiently cooked.

11 Claims, 3 Drawing Sheets

(56) References Cited

U.S. PATENT DOCUMENTS

| | | | | | |
|---|---|---|---|---|---|
| 4,313,418 | A * | 2/1982 | Schrader et al. | 126/287 |
| 4,326,495 | A * | 4/1982 | Millar | 126/77 |
| 4,336,789 | A * | 6/1982 | Ogawa | 126/21 A |
| 4,444,175 | A * | 4/1984 | Reynolds | 126/21 R |
| 4,475,529 | A * | 10/1984 | Milligan | 126/77 |
| 4,483,312 | A * | 11/1984 | Martenson | 126/77 |
| 4,516,012 | A * | 5/1985 | Smith et al. | 219/400 |
| 4,598,691 | A * | 7/1986 | Herrelko et al. | 126/41 R |
| 4,665,889 | A * | 5/1987 | Rumens et al. | 126/77 |
| 4,831,238 | A * | 5/1989 | Smith et al. | 219/400 |
| 4,951,645 | A * | 8/1990 | Luebke et al. | 126/20.1 |
| 5,204,503 | A * | 4/1993 | Maiellano et al. | 219/681 |
| 5,413,089 | A * | 5/1995 | Andors et al. | 126/77 |
| 5,655,511 | A * | 8/1997 | Prabhu et al. | 126/21 A |
| 6,227,189 | B1 * | 5/2001 | Dougherty | 126/21 A |
| 6,376,817 | B1 * | 4/2002 | McFadden et al. | 219/681 |
| 6,595,199 | B1 * | 7/2003 | Andersen et al. | 126/77 |
| 6,718,965 | B2 * | 4/2004 | Rummel et al. | 126/21 A |
| 6,854,457 | B2 * | 2/2005 | Rabas et al. | 126/21 A |
| 6,897,412 | B1 * | 5/2005 | Miller et al. | 219/400 |
| 7,094,998 | B2 * | 8/2006 | Shozo et al. | 219/681 |
| 7,109,448 | B2 * | 9/2006 | Goranson | 219/501 |
| 7,422,009 | B2 * | 9/2008 | Rummel et al. | 126/21 A |
| 7,507,938 | B2 * | 3/2009 | McFadden | 219/681 |
| 7,624,728 | B1 * | 12/2009 | Forbes | 126/21 A |
| 7,634,992 | B2 * | 12/2009 | Bujeau et al. | 126/21 A |
| 7,856,973 | B2 * | 12/2010 | Kim et al. | 126/273 R |
| 7,923,663 | B2 * | 4/2011 | Kim et al. | 219/391 |
| 8,071,922 | B2 * | 12/2011 | Claesson et al. | 219/681 |
| 2002/0134778 | A1 * | 9/2002 | Day et al. | 219/681 |
| 2004/0107595 | A1 * | 6/2004 | Kamimura et al. | 34/218 |
| 2005/0092314 | A1 * | 5/2005 | Rabas et al. | 126/21 A |
| 2007/0039198 | A1 * | 2/2007 | Boettcher et al. | 34/131 |
| 2007/0158328 | A1 * | 7/2007 | Kim et al. | 219/391 |
| 2010/0018072 | A1 * | 1/2010 | Kim et al. | 34/86 |
| 2010/0282731 | A1 * | 11/2010 | Jeong et al. | 219/400 |

* cited by examiner

OVEN RANGE

CROSS-REFERENCE TO RELATED APPLICATIONS

The present application is a 35 U.S.C. §371 National Stage entry of International Application No. PCT/KR2009/004268, filed Jul. 30, 2009 and claims priority under 35 U.S.C. §119 and 35 U.S.C. §365 to Korean Patent Application No. 10-2008-0075767 (filed on Aug. 1, 2008) and Korean Patent Application No. 10-2008-0075770 (filed on Aug. 1, 2008), each of which is hereby incorporated by reference in its entirety as if fully set forth herein.

BACKGROUND OF THE INVENTION

1. Field of the Invention

The present invention relates to a cooker, and more particularly, to an oven range cooking a cooking food using a burner heat.

2. Description of the Related Art

An oven range is a cooking appliance heating a cooking food seated in an oven chamber using a gas or an electric power. The oven range includes a burner for radiative-heating the cooking food in the oven chamber or/and a burner for convective-heating. However, in a known oven range, since a high-temperature airflow formed by the burner for convective-heating a does not evenly flow in the oven chamber, the cooking food in the oven chamber may not efficiently be heated. In particular, since a time when an inner temperature of the oven chamber reaches at a predetermined temperature is delayed in an initial heating, an entire cooking time of the cooking food is increased.

SUMMARY OF THE INVENTION

The present invention had been made in an effect to provide an oven range capable of cooking more efficiently a cooking food.

The present invention had been made in another effect to provide an oven range capable of increasing rapidly a temperature in an oven chamber in the initial heating.

An exemplary embodiment of the present invention provides an oven range including: an oven chamber cooking a cooking food; a heating chamber partitioned with the oven chamber; a heat source installed into the heating chamber for supplying a heat into the oven chamber; a communicating opening transferring an air heated by the heat source in the heating chamber into the oven chamber; an air duct guiding the air heated by the heat source so as to be transferred into the oven chamber through the communicating opening.

Another exemplary embodiment of the present invention provides an oven range including: an oven chamber cooking a cooking food; a heating chamber partitioned with the oven chamber; a heat source installed into the heating chamber for supplying a heat into the oven chamber; a communicating opening transferring an air heated by the heat source in the heating chamber into the oven chamber; an air duct guiding the heated air transferred into the oven chamber through the communicating opening so as to circulate in the oven chamber.

Yet another exemplary embodiment of the present invention provides an oven range including: a cavity having an oven chamber and a heating chamber; at least one burner installed in the heating chamber; a bottom plate partitioning the oven chamber and the heating chamber and having a communicating opening transferring an air heated by the burner into the oven chamber; a first guide member guiding the air heated by the burner to be transferred into the oven chamber through the communicating opening; a second guide member guiding the air transferred into the oven chamber through the communicating opening to circulate in the oven chamber According to an exemplary embodiment of the present invention, the cooking food can be more efficiently cooked.

DETAILED DESCRIPTION OF THE PREFERRED EMBODIMENTS

Hereinafter, an oven range according to an exemplary embodiment of the present invention will be described in detail with reference to drawings.

Figure 1:
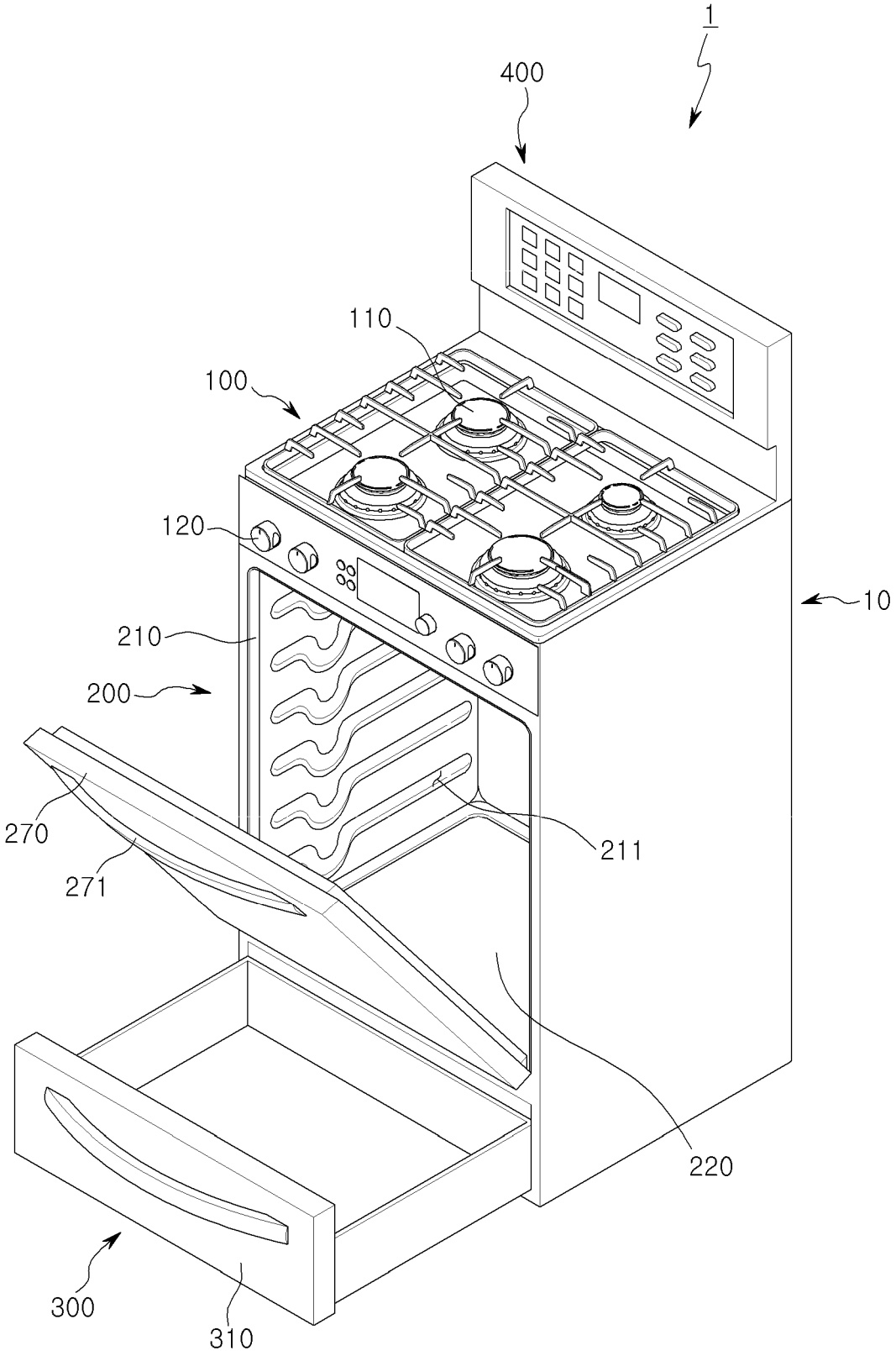
FIG. 1 is a perspective view showing an oven range according to an exemplary embodiment of the present invention.
Figure 2:
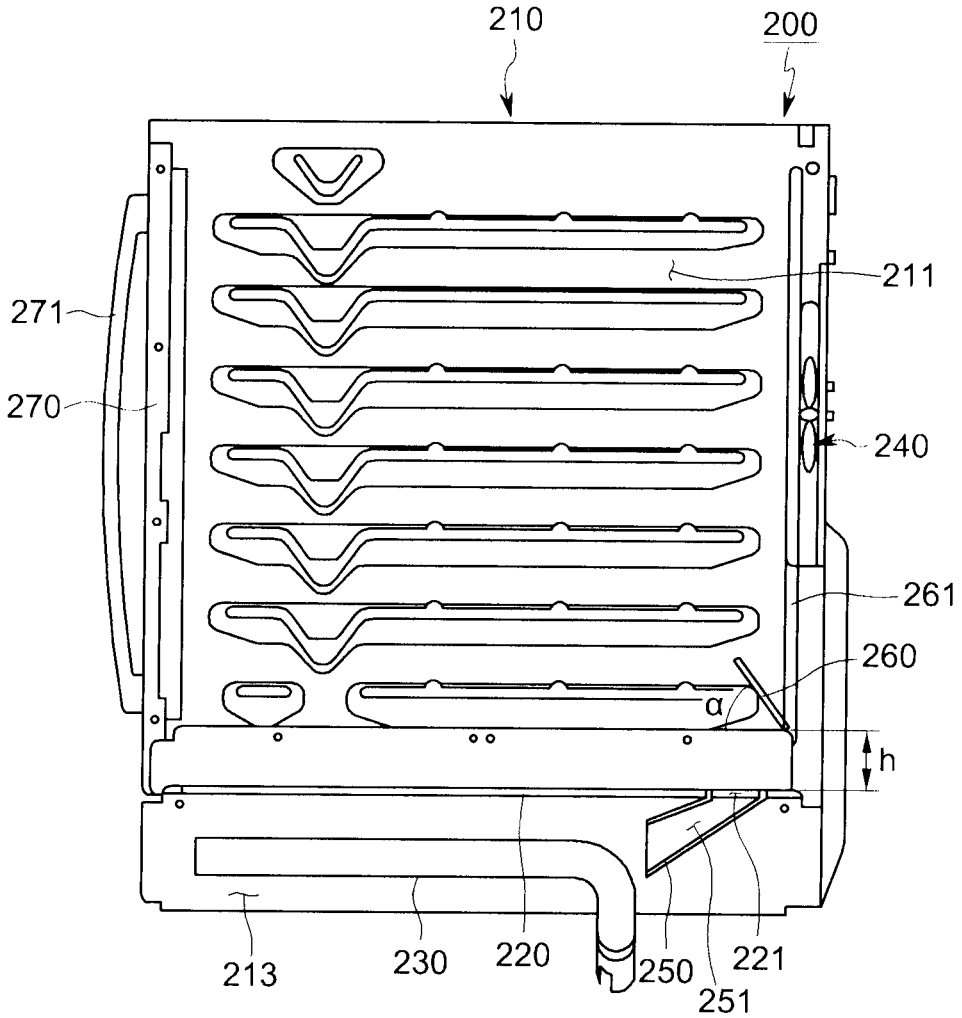
FIG. 2 is a longitudinal cross-sectional view showing a main part of the exemplary embodiment of the present invention.

FIG. 1 is a perspective view showing an oven range according to an exemplary embodiment of the present invention and FIG. 2 is a longitudinal sectional view showing a main part of the exemplary embodiment of the present invention.

Referring to FIG. 1, an oven range 1 includes a top plate part 100, an oven part 200, a drawer part 300, and a control part 400. The top plate part 100, the oven part 200, and the drawer part 300 are provided at the top, the center, and the bottom of a main body 10 of the oven range 1, respectively. In addition, the control part 400 is provided at a rear end on the top of the main body 10.

More particularly, the top plate part 100 includes a plurality of top plate burners 110. The top plate burner 110 cooks a cooking food by directly heating a container containing the cooking food with flame generated by burning a gas. The front end of the top plate part 100 includes a plurality of knobs 120. The knobs 120 control open and close or open degree of a valve (not shown) adjusting supply or not and supply amount of the gas into the top plate burner 110.

An oven cavity 210 of the oven part 200 is provided in the main body 10. Referring to FIG. 2, a space installing an oven chamber 211 cooking a cooking food and a burner chamber 213 including a lower burner 230 described later is provided.

Referring to FIG. 2, a bottom plate 220 is provided in the oven cavity 210. The bottom plate 220 partitions the space provided in the oven cavity 210 into upper and lower portions, that is, the oven chamber 211 and the burner chamber 213. In addition, a communicating opening 221 is formed at a rear end of the bottom plate 220. The communicating opening 221 is formed by cutting a part of the rear end of the bottom plate 220. The communicating opening 221 acts to communicate the oven chamber 211 with the burner chamber 213.

In addition, a lower burner 230 is installed in the burner chamber 213. The lower burner 230 convectively heats the cooking food in the oven chamber 211 with the heat generated by burning the gas. More particularly, the lower burner 230 heats air in the burner chamber 213 in order to heat the cooking food in the oven chamber 211. The air generated by the lower burner 230 is transferred into the oven chamber 211 through the communicating opening 221.

A convection fan 240 is installed at the rear of the oven chamber 211. The convection fan 240 acts to circulate the air heated by the lower burner 230 in the oven chamber 211.

Further, although not shown in the drawing, an upper burner is installed at the ceiling of the oven chamber 211. The upper burner radiatively heats the cooking food in the oven chamber 211 with the heat generated by burning the gas.

Meanwhile, an air duct 250 and an air guide 260 are provided in the burner chamber 213 and the oven chamber 211. The air duct 250 and the air guide 260 serve to guide the air heated by the lower burner 230 so as to entirely circulate in the oven chamber 211.

More particularly, the air duct 250 is provided in the burner chamber 213. Substantially, the air duct 250 is disposed between the lower burner 230 and the communicating opening 221 to guide the air heated by the lower burner 230 to the communicating opening 221. In this case, front ends of the air duct 250 are separately disposed above the lower burner 230 and rear ends of the air duct 250 are communicated with the communicating opening 221. In addition, the air duct 250 is upwardly slanted toward the rear end from the front end. Further, a channel 251 is provided in the air duct 250. A flow sectional-area of the channel 251 is reduced toward the rear end from the front end. Accordingly, a flow velocity of the air heated by the lower burner 230 is increased while flowing in the channel 251.

The air guide 260 is provided in the rear surface 261 of the oven chamber between the communicating opening 221 and the convection fan 240. The air guide 260 guides the air heated by the lower burner 230, which is guided by the air duct 250 to be transferred into the oven chamber 211 through the communicating opening 221, so as to evenly circulate it in the front end of the oven chamber 211 the most separated from the inside of the oven chamber 211, particularly, the communicating opening 221 and the convection fan 240. A time in which an inner temperature of the oven chamber 211 reaches 400° F. according to a height of the air guide 260 from the bottom of the oven chamber 211 and an angle of the air guide 260 with respect to the bottom of the oven chamber 211 is described in the following Table 1.

TABLE 1

| Height (mm) | Angle (°) | Time (sec) |
|---|---|---|
| 30 | 0 | 7.61 |
| | 30 | 7.70 |
| | 45 | 8.11 |
| 50 | 0 | 6.67 |
| | 30 | 7.95 |
| | 45 | 8.28 |
| 70 | 0 | 8.65 |
| | 30 | 8.83 |
| | 45 | 9.33 |

That is, referring to the Table 1, when the air guide 260 is provided in the rear surface 261 of the oven chamber so as to form an angle of 0 degree with the bottom of the oven chamber 211 at a height of 50 mm from the bottom of the oven chamber 211, the inner temperature of the oven chamber 211 the most rapidly reaches 400° F.

Meanwhile, the oven chamber 211 is selectively opened and closed by an oven door 270. The oven chamber 211 is opened and closed by the oven door 270 in a pull-down method in which an upper end of the door is vertically rotated based on a lower end of the door. A door handle 271 held with a user's hand in order to rotate the oven door 270 is provided at the top front of the oven door 270.

In addition, the drawer part 300 acts to warm the container containing the cooking food at a predetermined temperature. The drawer part 300 includes a drawer 310 storing the container.

Meanwhile, the control part 400 receives an operational signal for the operation of the cooker 1, more particularly, an operational signal for the operation of at least one of the top plate part 100, the oven part 200, and the drawer part 300. In addition, the control part 400 acts to externally display various information on the operation of the cooker 1.

Hereinafter, an operation of the oven range according to the exemplary embodiment of the present invention will be described in detail with reference to a drawing.

Figure 3:
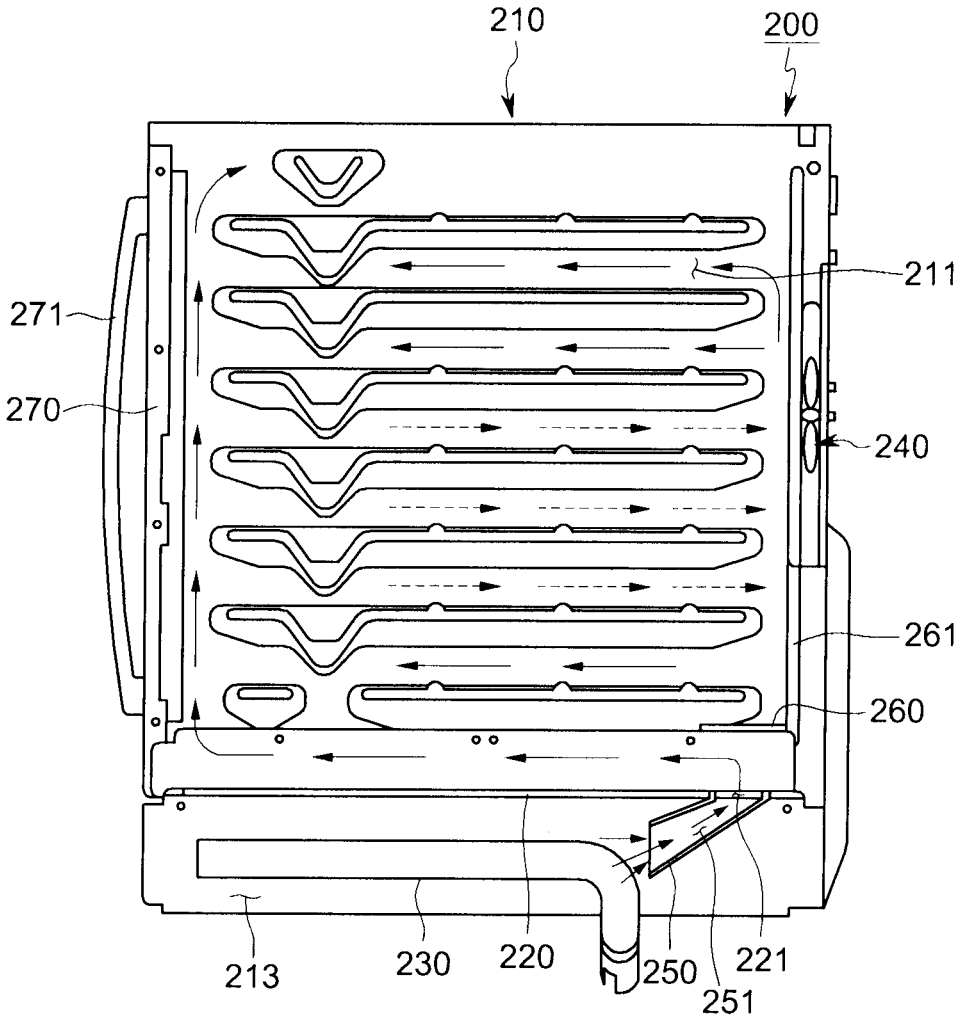
FIG. 3 is a longitudinal cross-sectional view showing airflows in an oven chamber and a burner chamber in the oven range according to the exemplary embodiment of the present invention.

FIG. 3 is a longitudinal cross-sectional view showing airflows in an oven chamber and a burner chamber in the oven range according to the exemplary embodiment of the present invention.

Referring to FIG. 3, a user operates the control part 400 to input an operational signal for operating the oven part 200. Accordingly, the lower burner 230 operates to heat the inner air of the burner chamber 213. In addition, when the convection fan 240 is driven, the air heated by the lower burner 230 circulates in the oven chamber 211.

More particularly, the air heated by the lower burner 230 is guided to the communicating opening 221 by the air duct 250. In this case, the air heated by the lower burner 230 is naturally convected to be guided by the air duct 250. However, the channel 251 provided in the air duct 250 has the flow cross-sectional area decreasing toward the communicating opening 221 from the lower burner 230. Accordingly, since the flow velocity of the air flowing in the channel 251 is increased, the air heated by the lower burner 230 is more efficiently transferred toward the communicating opening 221.

Meanwhile, the air guided by the air duct 250, that is, the air heated by the lower burner 230 is transferred into the oven chamber 211 through the communicating opening 221. In this case, the air transferred into the oven chamber 211 is guided by the air guide 260. Accordingly, when the convection fan 240 is driven, the air transferred into the oven chamber 211 is guided, particularly, toward the front end of the oven chamber 211 by the air guide 260, such that substantially, the air transferred into the oven chamber 211 entirely and evenly flows in the oven chamber 211. in addition, as shown in FIG. 3, when the air guide 240 forms an angle of 0 degree with the bottom of the oven chamber 211, that is, extends parallel to the bottom of the oven chamber 211, the air heated by the lower burner 230 can more evenly circulate in the oven chamber 211.

As set forth above, in the oven range according to the exemplary embodiment of the present invention, a high-temperature airflow formed by the lower burner is guided by the air duct or/and the air guide to evenly circulate in the oven chamber. Therefore, the cooking food in the oven chamber is entirely and evenly heated, such that substantially, the cooking food can be efficiently cooked.

It will be appreciated by those skilled in the art that substitutions, modifications, and changes may be made in these embodiments without departing from the principles and the spirit of the general inventive concept, the scope of which is defined in the appended claims and their equivalents.

What is claimed is:

1. An oven range, comprising:

an oven chamber to cook a cooking food;

a door that opens or closes the oven chamber;

a heating chamber disposed under the oven chamber;

a bottom plate partitioning between the oven chamber and the heating chamber;

a heat source installed into the heating chamber for heating air in the heating chamber;

a communicating opening disposed on the bottom plate and transferring air heated by the heat source in the heating chamber into the oven chamber;

an air duct guiding the air heated by the heat source so as to be transferred into the oven chamber through the communicating opening; and an air guide extended from a rear surface of the oven chamber toward the door, the air guide being disposed above the communicating opening and being spaced apart from the bottom plate and the communicating opening, and facing with the communicating opening, wherein the air duct is disposed between the heat source and the communicating opening, wherein the air duct is upwardly slanted toward the communicating opening from the heat source, wherein the air guide parallel to the bottom plate guides the air transferred into the oven chamber through the communicating opening to a front end of the oven chamber toward the door and air guide maintains facing with the communicating opening during guiding of the air transferred into the oven chamber through the communicating opening.

2. The oven range of claim 1, wherein one end of the air duct is disposed above the heat source and the other end of the air duct is communicated with the communicating opening.

3. The oven range of claim 1, wherein the flow cross-sectional area in the air duct is decreased toward the communicating opening.

4. The oven range of claim 1, wherein the heated air transferred into the oven chamber by the air duct circulates in the oven chamber by the driving of a convection fan.

5. The oven range of claim 1, wherein the communicating opening communicates the oven chamber with a part of the rear end of the heating chamber.

6. The oven range of claim 1, wherein the air guide is installed between the upper part of the communicating opening and a convection fan circulating the air transferred into the oven chamber.

7. The oven range of claim 1, wherein the air guide is provided at the rear surface of the oven chamber of a predetermined height.

8. The oven range of claim 1, wherein the air guide is provided at the rear surface of the oven chamber corresponding to a height of 30 mm to 70 mm from the bottom of the oven chamber.

9. The oven range of claim 1, wherein the air guide extends toward the door upwardly-inclined at a predetermined angle.

10. The oven range of claim 1, wherein the air guide extends to the door so as to form an angle of 0 degree to 45 degrees with the bottom of the oven chamber.

11. The oven range of claim 1, wherein the air guide extends to the door so as to form an angle of 0 degree with the bottom of the oven chamber in the rear of the oven chamber corresponding to a height of 50 mm from the bottom of the oven chamber.

* * * * *